US010265584B2

(12) United States Patent
Chiang

(10) Patent No.: US 10,265,584 B2
(45) Date of Patent: Apr. 23, 2019

(54) SWIMMING GOGGLES

(71) Applicant: Global Esprit Inc., New Taipei (TW)

(72) Inventor: Herman Chiang, New Taipei (TW)

(73) Assignee: GLOBAL ESPRIT INC., New Taipei (TW)

( * ) Notice: Subject to any disclaimer, the term of this patent is extended or adjusted under 35 U.S.C. 154(b) by 865 days.

(21) Appl. No.: 14/458,250

(22) Filed: Aug. 12, 2014

(65) Prior Publication Data

US 2016/0030811 A1 Feb. 4, 2016

(30) Foreign Application Priority Data

Jul. 31, 2014 (TW) ..... 103213584 U

(51) Int. Cl.
*A63B 33/00* (2006.01)
*A63B 71/06* (2006.01)

(52) U.S. Cl.
CPC ..... *A63B 33/002* (2013.01); *A63B 2033/004* (2013.01); *A63B 2071/0694* (2013.01); *A63B 2208/12* (2013.01)

(58) Field of Classification Search
CPC ..... A63B 33/002; A63B 2033/004; A63B 2208/12; A63B 2071/0694
USPC ..... 2/440, 439, 442, 443, 445, 428, 426
See application file for complete search history.

(56) References Cited

U.S. PATENT DOCUMENTS 4,373,788 A * 2/1983 Herbert ..... A63B 33/00 351/43
5,603,125 A * 2/1997 Chou ..... A63B 33/002 2/428
6,317,897 B1 * 11/2001 Chiang ..... A63B 33/002 2/428
8,065,752 B2 * 11/2011 Kuroda ..... B63C 11/12 2/428
2007/0277297 A1 * 12/2007 Chiang ..... A63B 33/002 2/426
2008/0263753 A1 * 10/2008 Chiang ..... A63B 33/002 2/431
2010/0024098 A1 * 2/2010 Chiang ..... A63B 33/002 2/428
2011/0191948 A1 * 8/2011 Chiang ..... A63B 33/002 2/440

(Continued)

*Primary Examiner* — Khaled Annis
*Assistant Examiner* — Brieanna Szafran
(74) *Attorney, Agent, or Firm* — Cheng-Ju Chiang

(57) ABSTRACT

Swimming goggles comprise a lens frame having an inner circumference surface and an outer circumference surface; a decorative frame assembled with the lens frame and located on a side of the outer circumference surface; and head strap devices at least comprising a head strap being of the buoyancy in water, and brackets made for perforation and orientation of the head strap, and further, the head strap having a first linking element and a second linking element capable of being connected or separated each other; wherein the swimming goggles have no sharp corners on their contour causing the injury, could not be disassembled again after assembled to prevent children from mistakenly swallowing their fallen components, provide the buoyancy in water when accidentally fell into water for ease of pickup for children's safety, and have the decorative frame that could simulate images of cartoon characters to bring out nifty and happy feelings.

5 Claims, 7 Drawing Sheets

(56) References Cited

U.S. PATENT DOCUMENTS

| | | | | |
|---|---|---|---|---|
| 2011/0271432 | A1* | 11/2011 | Chiang | A63B 33/002 2/440 |
| 2012/0246810 | A1* | 10/2012 | Chiang | A63B 33/002 2/428 |
| 2013/0139305 | A1* | 6/2013 | Rao | A61F 9/027 2/452 |

* cited by examiner

SWIMMING GOGGLES

BACKGROUND OF THE INVENTION

1. Field of the Invention

The present invention relates to swimming goggles, and particularly to swimming goggles suitable for children, capable of providing the safety wearing, as well as of bringing out nifty and happy feelings.

2. Related Art

Nowadays, people have developed several types of swimming goggles for different functions. Generally, they are made for water resistance, convenience of adjustment of head strap, and comfort for the contact of face. Because the appearance is quite limited by the structure designed in accordance with some function demands as well as by adult's way of thinking about further improvements of swimming goggles, the appearance of swimming goggles becomes difficult to diverge from conventional visual feelings.

It is believed that playing with each other in shallow water is what children would usually do in swimming pool, so that the functionality of swimming goggles for swimming is not the first thing that the provider would consider about. Instead, the convenience and safety of the swimming goggles for children are much more important, and the appearance of the swimming goggles needs to be well-designed for loveliness. Besides, if we try to shrink the swimming goggles used in adult to make it fit to the face of children, it may occur that the head strap becomes hard to adjust and thus produces uncomfortable feelings, the sharp corners formed on the contour of the components of swimming goggles easily cut the children, the components fell apart and scattered in water are mistakenly swallowed by children, or it likely to cause danger that children try to get the fallen swimming goggles back under the water. Briefly, the conventional swimming goggles are rarely designed in terms of safety, comfort and appearance, so they still need to be improved to preferably satisfy children's needs.

SUMMARY OF THE INVENTION

Accordingly, an object of the present invention is to provide swimming goggles that are in compliance with the national safety standards with no sharp corners on their contour causing the injury, and after assembled, their components could not be disassembled again to prevent children from mistakenly swallowing the fallen components scattered in the water.

Another object of the present invention is to provide swimming goggles having decorative frames in the front to give nifty and happy feelings, that is, the decorative frames could be designed in accordance with cartoon characters, e.g., the decorative frames have circular rings in harmony with the circular lenses to make the left and right frames more abrupt as if they are circular glasses in appearance, in order to simulate an image of Harry Potter, and alternatively, the decorative frames could also shape an image of Mickey Mouse to bring out nifty and happy feelings.

Still another object of the present invention is to provide swimming goggles, capable of quick positioning and adjustment in accordance with the size of child's head, by a head strap that could be connected or separated each other rapidly.

To achieve the above-mentioned objects, the swimming goggles comprise a lens frame having an inner circumference surface and an outer circumference surface; a decorative frame assembled with the lens frame and located on a side of the outer circumference surface of the lens frame; lenses and protection pads both assembled with the lens frame; and head strap devices at least comprising a head strap being of the buoyancy in water, and brackets made for perforation and orientation of the head strap, and further, the head strap having a first linking element and a second linking element capable of being connected or separated each other; wherein the swimming goggles have no sharp corners on their contour causing the injury, could not be disassembled again after assembled to prevent children from mistakenly swallowing their fallen components scattered in the water, provide the buoyancy in water such that when accidentally fell into water, it would keep afloat on the surface of water for ease of pickup for children's safety, and have the decorative frame that could simulate images of cartoon characters to bring out nifty and happy feelings.

According to one aspect of the present invention, the decorative frames having special frame types have circular rings to simulate an image of Harry Potter or the decorative frames shape an image of Mickey Mouse, to bring out visual senses from those cartoon characters.

According to another aspect of the present invention, the head strap having 2 mm in thickness, which could be considered as the best thickness, comprises a foam layer and a cloth layer formed on the upper or lower surface of the foam layer, wherein the foam layer is made of foam, while the cloth layer is made of polyester as so-called dacron or of spandex as so-called LYCRA, wherein the cloth layer could be decorated with any patterns printed on the surface of the cloth layer, such that a pattern that shows more characteristics in accordance with the image of cartoon character or animal that the decorative frames is trying to simulate, or of a trademark pattern.

DESCRIPTION OF THE PREFERRED EMBODIMENTS

Figure 1:
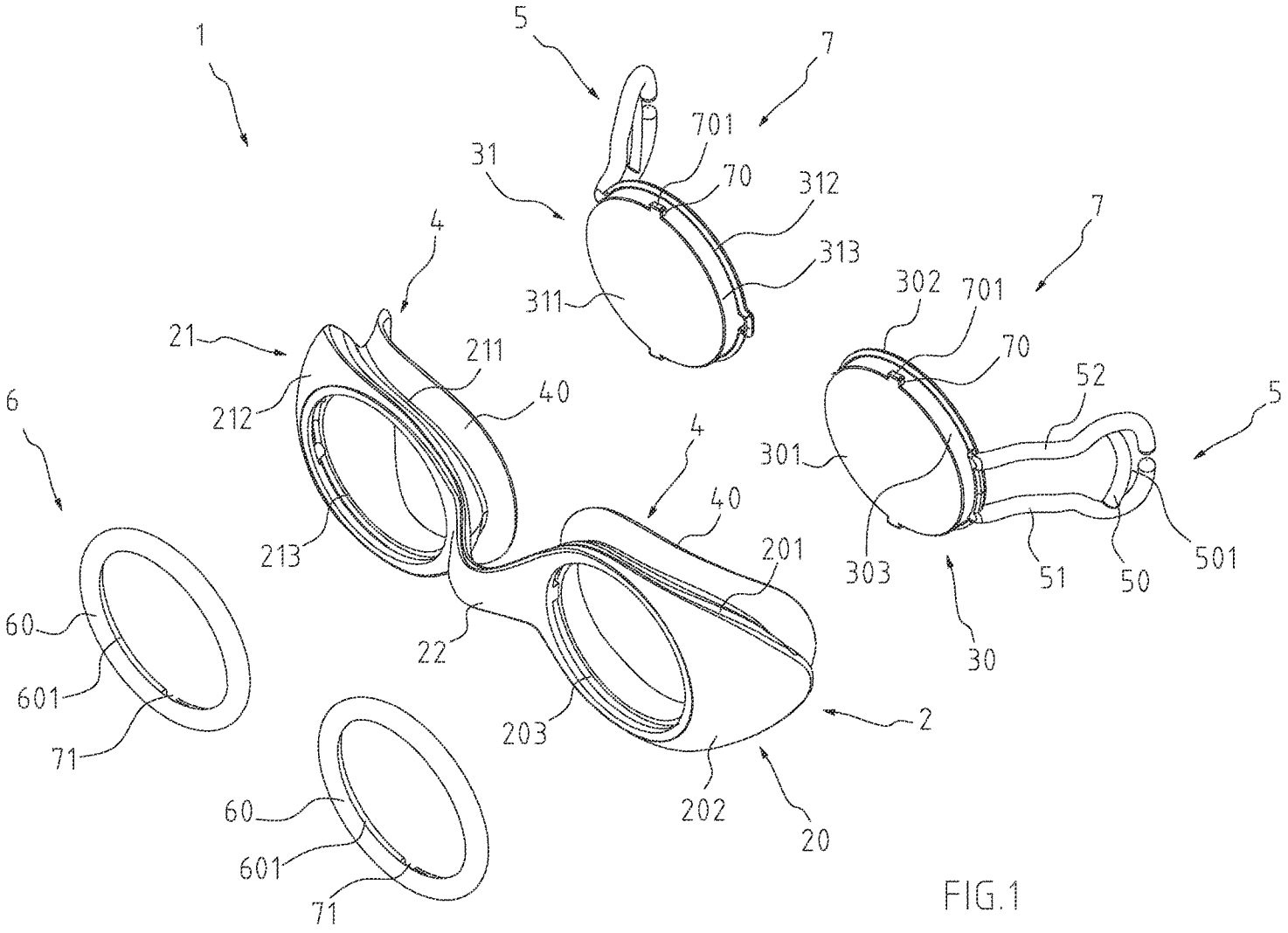
FIG. 1 is an exploded perspective view of swimming goggles of the present invention.

Referring to FIGS. 1 to 7, swimming goggles 1 of the present invention comprise a lens frame 2, a connecting element 22, lenses 30, 31, protection pads 4, head strap devices 5, decorative frames 6, and engagement devices 7, wherein the lens frame 2 is provided by a left frame 20, a right frame 21 and the connecting element 22 integrally formed in the injection molding of thermo plastic rubber.

The left and right frames 20, 21 have inner circumference surfaces 201, 211 and outer circumference surfaces 202, 212, respectively, and the inner circumference surfaces 201, 211 and the outer circumference surfaces 202, 212 form holding grooves 203, 213 therebetween. The protection pads 4 having J-shaped face contact portions 40 are integrally formed with the inner circumference surfaces 201, 211 of the left and right frames 20, 21, wherein the face contact portions 40 have a wavy shape consistent with the contour of the eye socket (see FIG. 6, a and b, for example, are the highest and lowest points of the wavy shape, respectively), thereby giving a sense of comfort as well as a waterproof effect. The lenses 30, 31 made of polycarbonate resin and shaped as circle have lens bodies 301, 311, and the lens bodies 301, 311 form lips 302, 312 and peripheral surfaces 303, 313 thereon.

Figure 8:
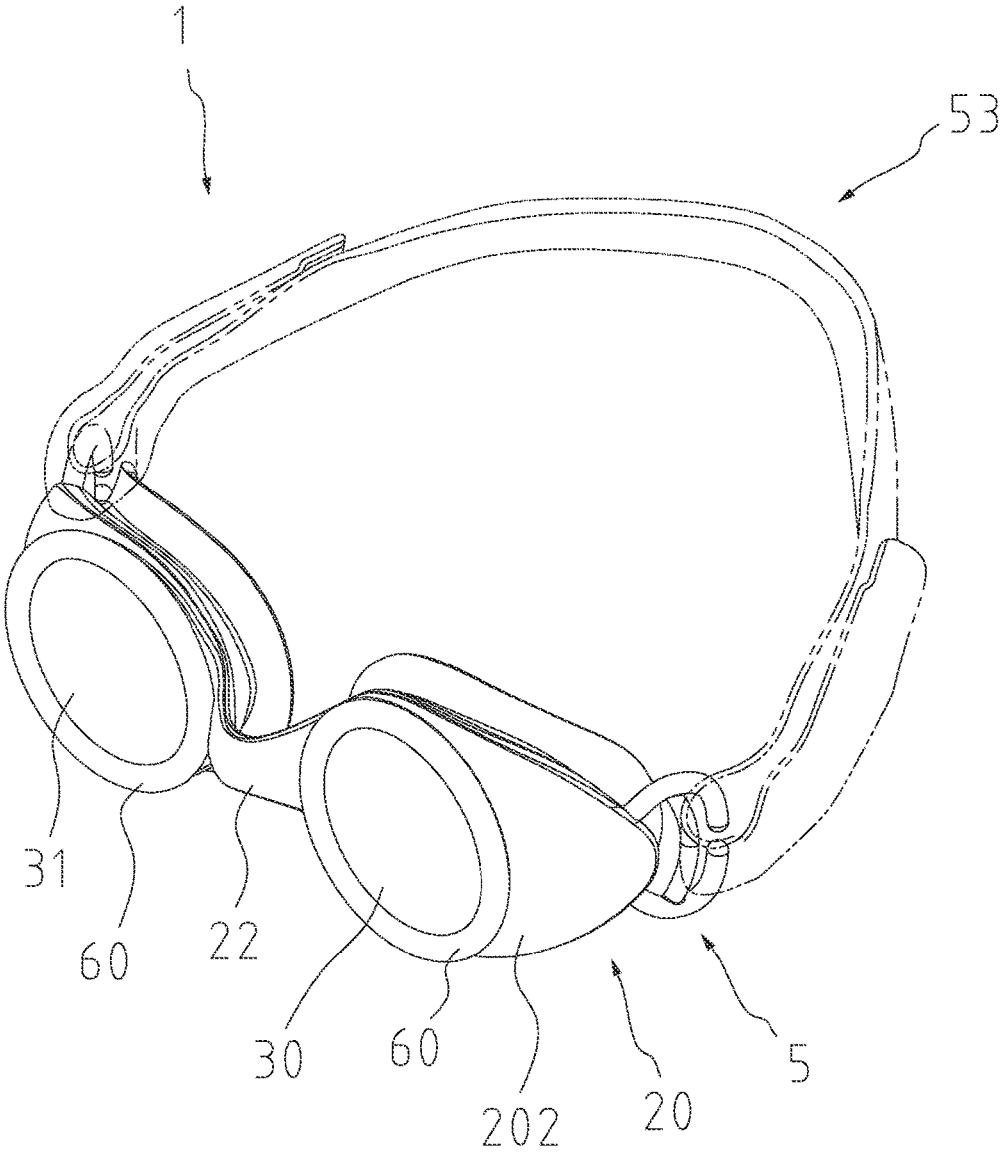
FIG. 8 is a schematic view illustrating the assembly of the head strap having linking elements with swimming goggles of the present invention.
Figure 9:
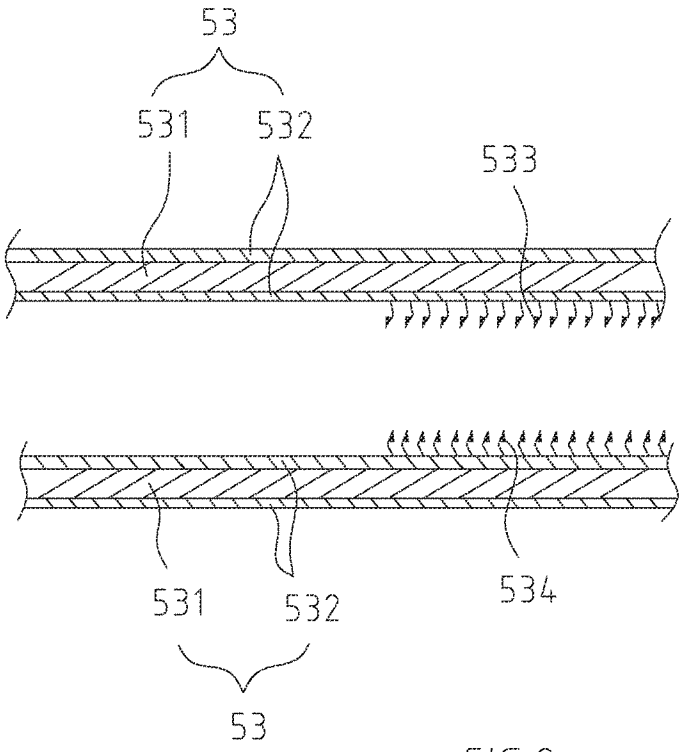
FIG. 9 is a partial cross-sectional view in accordance with two ends of the head strap of the present invention.

The head strap devices 5 comprises brackets 50, support arms 51, 52 and head strap 53 shown as dotted lines in FIG. 8, wherein each of the brackets 50 having a circular-arc contour forms a through hole 501 thereon for perforation and orientation of head strap. The support arms 51, 52 provide the support of the brackets 50 as a basis for grasping plastics in the injection molding. The brackets 50 and the support arms 51, 52 are made of polycarbonate resin, just like as the lenses 30, 31. The support arms 51, 52 are integrally formed with the lips 302, 312 of the lens bodies 301, 311, i.e., the lips 302, 312 and the support arms 51, 52 are clad together as one when the left and right frames 20, 21 and the connecting element 22 are integrally formed in the injection molding. In other words, before the injection molding of the left and right frames 20, 21, the lens bodies 301, 311 and the support arms 51, 52 are imbedded and make the lips 302, 312 received in the holding grooves 203, 213, and, after the injection molding, the lens bodies 301, 311 and the support arms 51, 52 are clad and the peripheral surfaces 303,313 of the lens bodies 301, 311 are allowed to be exposed. The head strap 53 having 2 mm in thickness, which could be considered as the best thickness, comprises a foam layer 531 and a cloth layer 532 formed on the upper or lower surface of the foam layer 531, wherein the foam layer 531 is made of foam, while the cloth layer 532 is made of polyester as so-called dacron or of spandex as so-called LYCRA, so as to provide the flexibility for the protection of wearer's head, and also provide the buoyancy in water, e.g., when accidentally fell into water, it would keep afloat on the surface of water for ease of pickup. Further, the head strap 53 has a first linking element 533 and a second linking element 534 on its both sides as shown in FIG. 9. The first linking element 533 and the second linking element 534 could be connected or separated each other rapidly so as to enable quick positioning and adjustment in accordance with the size of wearer's head when worn, and quick separation when taken off. The cloth layer 532 could be decorated with any patterns printed on the surface of the cloth layer 532, e.g., a pattern that shows more characteristics in accordance with the image of cartoon character or animal that the decorative frames 6 is trying to simulate, or even of a trademark pattern not shown here in Figures, might be a good example too, so that the brackets 50 of the head strap devices 5, the support arms 51, 52 and the head strap 53 with the design of circular-arc contours provide children with the safety wearing in compliance with the national safety standards, and besides that, the first linking element 533 and the second linking element 534 formed on the head strap 53, such as Velcro, enable quick positioning and adjustment in accordance with the size of wearer's head when worn.

Figure 10:
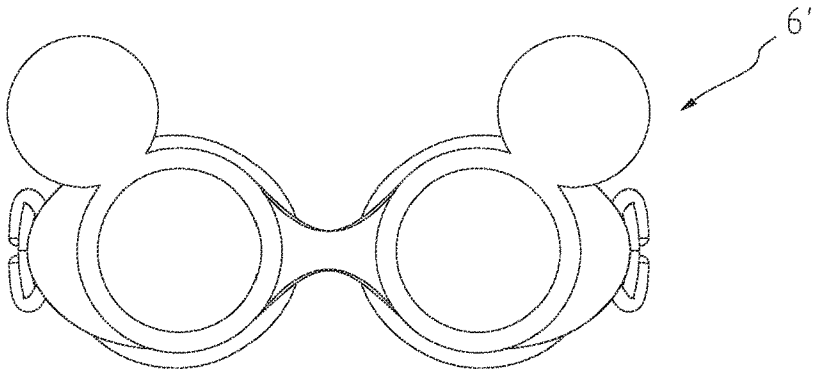
FIGS. 10 and 11 are the second embodiment and the third embodiment respectively in accordance with decorative frames of the present invention.
Figure 11:
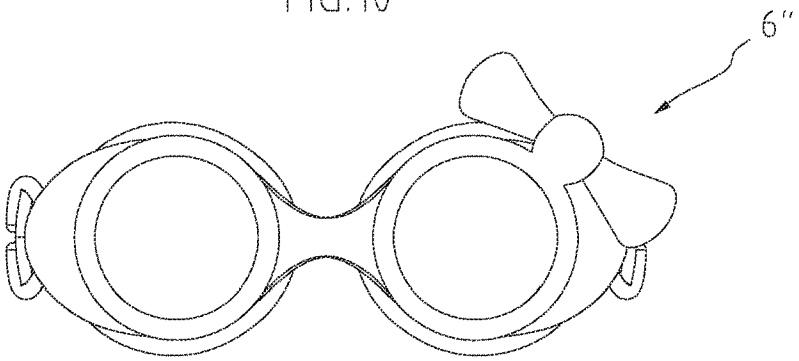

The decorative frames 6 made of polycarbonate resin have special frame types; in this embodiment, the decorative frames 6 have circular rings 60 in harmony with the circular lenses 30, 31 to make the left and right frames 20, 21 more abrupt as if they are circular glasses in appearance, in order to simulate an image of Harry Potter. Furthermore, each of the circular rings 60 has a ring groove 601 which takes in the peripheral surfaces 303, 313 exposed out of the lens bodies 301, 311 to preferably integrate the decorative frames 6 and the lens bodies 301, 311 together. Please further referring to FIGS. 10 and 11, as the second and third embodiments illustrating the decorative frames, as shown, the decorative frames 6', 6" could also shape an image of Mickey Mouse to bring out nifty and happy feelings.

Figure 1B:
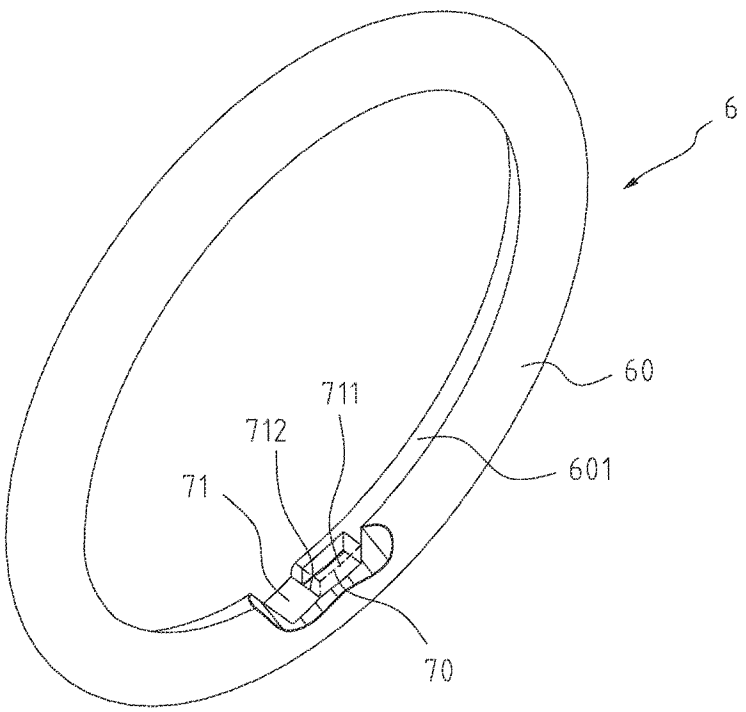
FIGS. 1A and 1B are partial cross-sectional perspective views in accordance with decorative frames of the present invention.
Figure 1A:
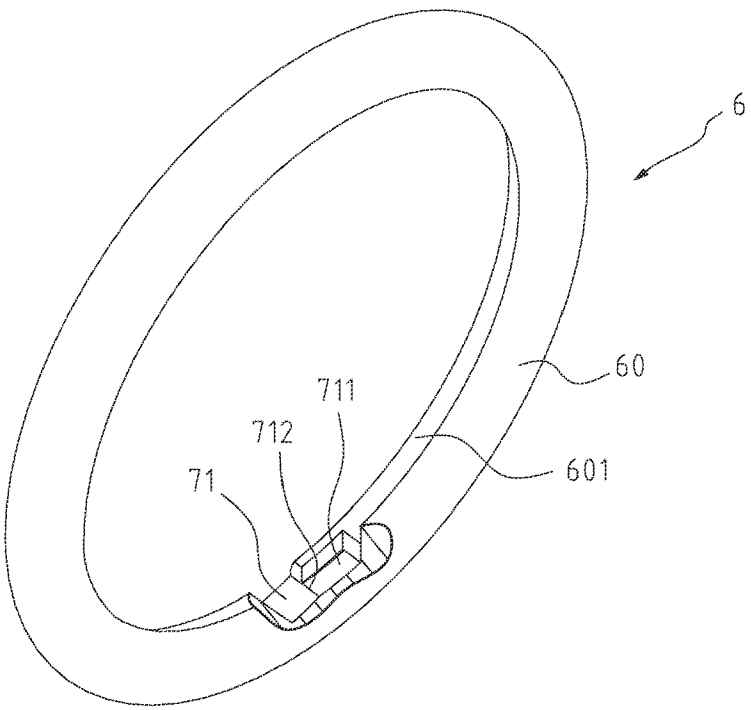

Each of the engagement devices 7 comprises a positioning rib 70 and a slot 71 that are intermeshed together and are assembled with the peripheral surfaces 303, 313 exposed out of the lens bodies 301, 311 and the decorative frames 6, respectively, that is, the positioning rib 70 assembled with the peripheral surfaces 303, 313 exposed out of the lens bodies 301, 311 has a rectangular shape and has a guiding side 701. As shown in FIG. 1, the slot 71 is formed on a side of the ring groove 601 of the circular rings 60 and communicating with the ring groove 601, that is, the slot 71 forms an inclined channel 711 along the ring groove 601 and further, the inclined channel 711 forms a retaining wall 712. When the circular rings 60 are assembled with the peripheral surfaces 303, 313 exposed out of the lens bodies 301, 311, the positioning rib 70 is assembled with the slot 71. Next, when the guiding side 701 is assembled along the inclined channel 711, the positioning rib 70 is stuck by the retaining wall 712 (see FIGS. 4-5 and the dotted lines in FIG. 1B). Therefore, after assembled with the outer circumference surfaces 202, 212, the circular rings 60 could not be disassembled again to prevent children from mistakenly swallowing the fallen components scattered in the water. Alternatively, the circular rings 60 could be integrally formed with the outer circumference surfaces 202, 212 instead of using the engagement devices 7 for the same purpose.

Figure 2:
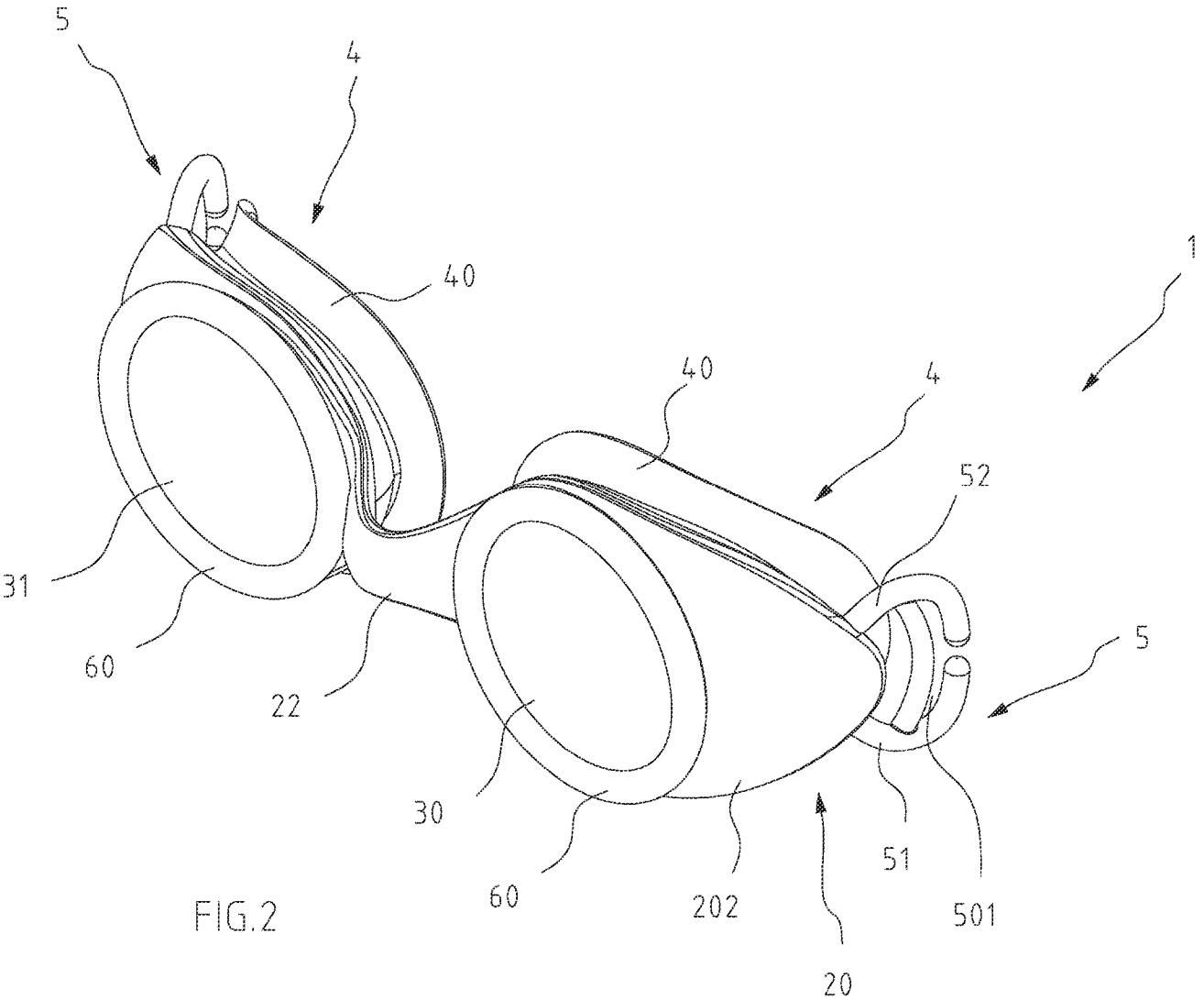
FIG. 2 is an assembly view of swimming goggles of the present invention.
Figure 3:
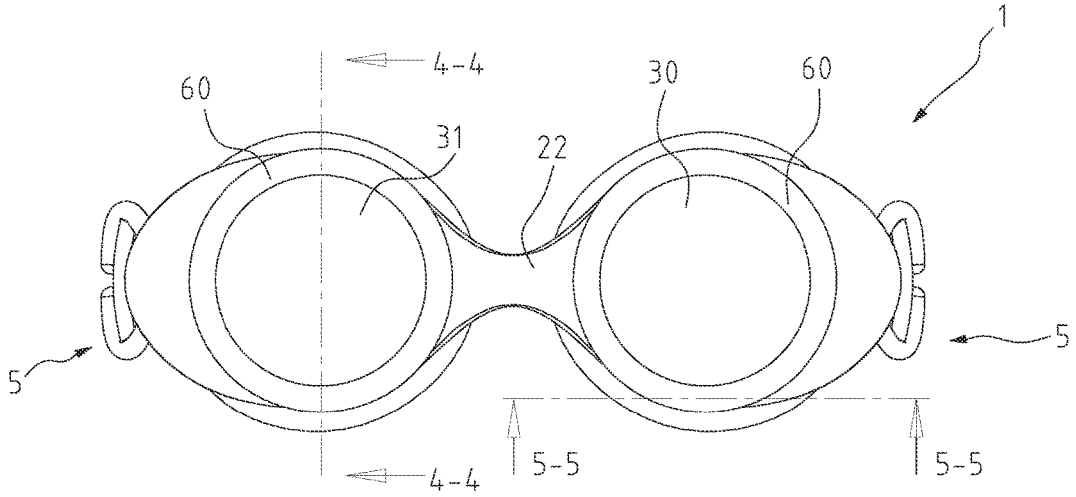
FIG. 3 is a front elevational view of FIG. 2.
Figure 4:
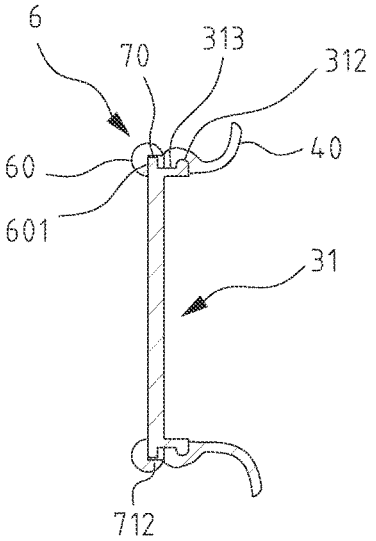
FIGS. 4 and 5 are cross-sectional views taken along lines 4-4, 5-5 of FIG. 2, respectively.
Figure 5:
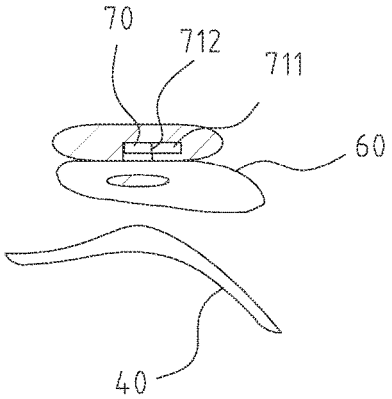
Figure 6:
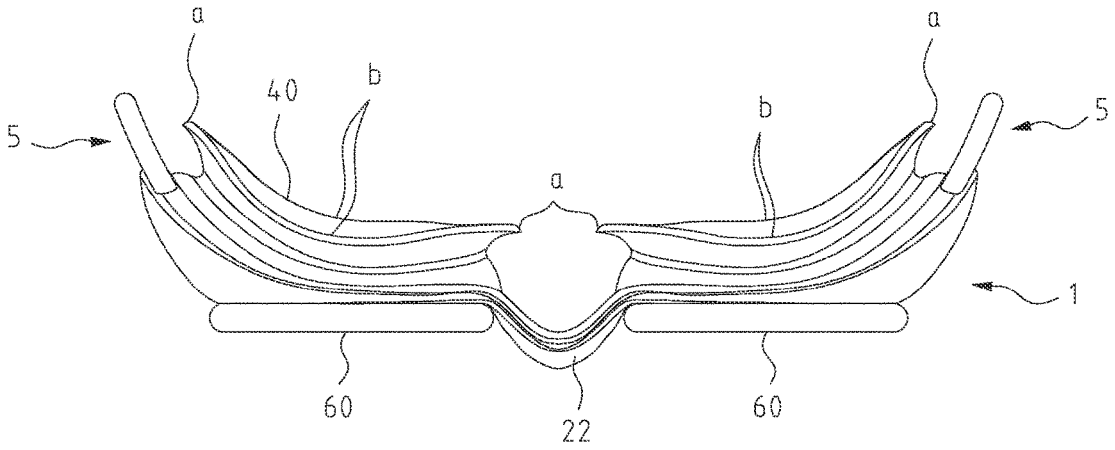
FIGS. 6 and 7 are a top plan view and a side view of FIG. 2, respectively.
Figure 7:
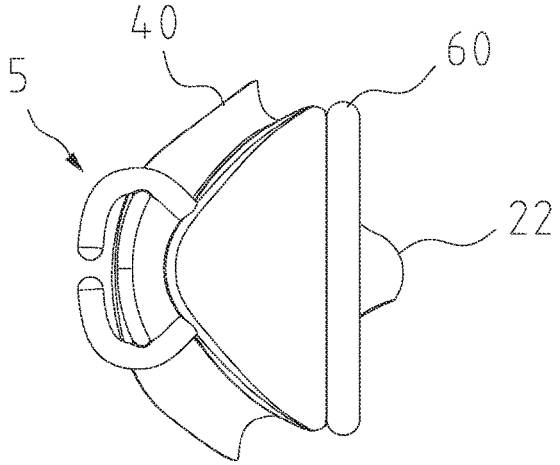

In sum, referring to FIG. 2, swimming goggles 1 could make the left and right frames 20, 21 simulate an image of Harry Potter due to the settings of the circular rings 60 and the lenses 30, 31 in order to bring out nifty and happy feelings. Further, the brackets 50 of the head strap devices 5 are of circular-arc design to provide children with the safety wearing and in addition, the Velcro and the foam both defined in the head strap 53 provide swimming goggles 1 with comfort feelings and some buoyancy in water so as to enable quick positioning and adjustment in accordance with the size of child's head. Next, the positioning rib 70 and the slot 71 intermeshed together could not be disassembled again to prevent children from mistakenly swallowing the fallen components scattered in the water. Therefore, swimming goggles of the present invention could provide children with the safety wearing.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, suitable for children to use, comprising:

a lens frame having an inner circumference surface, an outer circumference surface and a holding groove formed between the inner circumference surface and the outer circumference surface, the lens frame including a left frame, a right frame and a connecting element interconnecting the left frame and the right frame, wherein the left frame, the right frame and the connecting element are integrally formed in the injection molding of thermo plastic rubber;

decorative frames located on a side of the outer circumference surface of the lens frame, each of the decorative frames defined with a circular ring, and the circular ring being formed with a ring groove;

lenses assembled with the lens frame, each of the lenses having a circle shape and comprising of a lens body and a lip, a peripheral surface of the lens body being partially exposed out of and extended beyond the outer circumference surface of each of the left frame and the right frame while the lip being directly engaged received in the holding groove of the lens frame, and the peripheral surface of the lens body being received in the ring groove of each of the decorative frames;

protection pads assembled with the lens frame, each of the protection pads mounted with a J-shaped face contact portion in a wavy shape, the J-shaped face contact portion is integrally formed with the inner circumference surface of the lens frame;

engagement devices arranged between the lenses and the decorative frames, each of the engagement devices comprising a slot and a positioning rib combinable with the slot, the slot being formed on the circular ring while the positioning rib being positioned on the peripheral surface of the lens body of each of the lenses, the positioning rib having a rectangular shape and having a guiding side, and the slot having an inclined channel formed along the circular ring of each of the decorative frames, and the inclined channel of the slot being formed with a retaining wall to engage with the guiding side of the positioning rib, the positioning rib being stuck by the retaining wall in the slot to ensure that the decorative frames are non-detachable from the lenses; and head strap devices at least comprising a head strap having floatability in water, and brackets made for perforation and orientation of the head strap, the head strap having a first linking element and a second linking element capable of being connected or separated with the first linking element.

2. The swimming goggles of claim 1, wherein the head strap having 2 mm in thickness comprises a foam layer and a cloth layer, the cloth layer being formed on an upper or lower surface of the foam layer, wherein the foam layer is made of foam, and the cloth layer is made of polyester or of spandex.

3. The swimming goggles of claim 1, wherein the slot is formed on a side of the circular ring and communicating with the ring groove.

4. The swimming goggles of claim 1, wherein each of the head strap devices comprises a plurality of support arms, and the plurality of support arms are integrally formed with and extended from the lip of the lens body.

5. The swimming goggles of claim 2, wherein the cloth layer is decorated with a pattern printed on surfaces of the cloth layer, and the pattern comprises a cartoon image or an animal image.

* * * * *